US009941103B2

(12) United States Patent
Mackay et al.

(10) Patent No.: US 9,941,103 B2
(45) Date of Patent: Apr. 10, 2018

(54) BIAS-VARIANT PHOTOMULTIPLIER TUBE

(71) Applicant: KLA-Tencor Corporation, Milpitas, CA (US)

(72) Inventors: Derek Mackay, Menlo Park, CA (US); Paul Donders, Fremont, CA (US); Kai Cao, Fremont, CA (US); Jeongsik Lim, Sunnyvale, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 235 days.

(21) Appl. No.: 14/517,375

(22) Filed: Oct. 17, 2014

(65) Prior Publication Data

US 2015/0136948 A1 May 21, 2015

Related U.S. Application Data

(60) Provisional application No. 61/893,190, filed on Oct. 19, 2013.

(51) Int. Cl.

| | |
|---|---|
| ***H01J 40/14*** | (2006.01) |
| ***H01J 40/12*** | (2006.01) |
| ***H01J 40/16*** | (2006.01) |
| ***H01J 43/20*** | (2006.01) |

(52) U.S. Cl.

CPC ..... *H01J 40/12* (2013.01); *H01J 40/16* (2013.01); *H01J 43/20* (2013.01)

(58) Field of Classification Search

CPC ..... H01J 40/12; H01J 40/16; H01J 43/20
USPC ..... 250/207
See application file for complete search history.

(56) References Cited

U.S. PATENT DOCUMENTS

| | | | | |
|---|---|---|---|---|
| 3,641,352 | A * | 2/1972 | Fisher | H01J 43/14 250/207 |
| 3,739,216 | A * | 6/1973 | Pakswer | H01J 43/20 313/105 CM |
| 3,997,779 | A * | 12/1976 | Rabl | H01J 43/30 250/207 |
| 4,649,269 | A * | 3/1987 | Persyk | H01J 43/30 250/207 |
| 5,367,222 | A * | 11/1994 | Binkley | H01J 43/30 313/533 |
| 7,005,625 | B1 * | 2/2006 | Mitchell | H01J 43/30 250/207 |
| 7,030,355 | B1 | 4/2006 | Bochenski et al. | |
| 8,139,840 | B1 * | 3/2012 | Chu | G01N 21/8851 382/141 |
| 2004/0016867 | A1 * | 1/2004 | Milshtein | H01J 43/30 250/207 |
| 2005/0206886 | A1 | 9/2005 | Vaez-Iravani et al. | |

(Continued)

*Primary Examiner* — Georgia Y Epps
*Assistant Examiner* — Kevin Wyatt
(74) *Attorney, Agent, or Firm* — Suiter Swantz pc llo

(57) ABSTRACT

A bias-variant photomultiplier tube (PMT) includes a photocathode that when operating absorbs photons and emits photoelectrons responsive to the absorbed photons. The bias-variant PMTO also includes a plurality of dynodes that receive the photoelectrons emitted by the photocathode. The plurality of dynodes include a first pair of dynodes having a first bias difference and at least a second pair of dynodes having a second bias difference. The second bias difference is greater than the first bias difference. The bias-variant PMTO also includes an anode to receive photoelectrons directed from the plurality of dynodes.

17 Claims, 6 Drawing Sheets

(56) References Cited

U.S. PATENT DOCUMENTS

| | | | | |
|---|---|---|---|---|
| 2006/0043259 | A1 | 3/2006 | Thompson | |
| 2009/0059215 | A1* | 3/2009 | Mehanian | G01N 21/8806 356/237.2 |
| 2010/0133427 | A1 | 6/2010 | Patt et al. | |
| 2012/0224183 | A1* | 9/2012 | Fay | G01B 9/0209 356/491 |
| 2013/0126705 | A1* | 5/2013 | Maleev | H01J 40/06 250/207 |
| 2013/0264464 | A1* | 10/2013 | Heifets | G01J 1/44 250/207 |

* cited by examiner

BIAS-VARIANT PHOTOMULTIPLIER TUBE

RELATED APPLICATIONS

For purposes of the USPTO extra-statutory requirements, the present application constitutes a regular (non-provisional) patent application of United States Provisional Patent Application entitled EXTENDED LIFETIME PHOTOMULTIPLIER TUBE, naming Derek Mackay, Paul Donders, Kai Cao, and Jeongsik Lim as inventors, filed Oct. 19, 2013, Application Ser. No. 61/893,190. Application Ser. No. 61/893,190 is incorporated herein by reference in the entirety.

CROSS-REFERENCE TO RELATED APPLICATION

The present application is related to and claims the benefit of the earliest available effective filing date(s) from the following listed application(s) (the "Related Applications") (e.g., claims earliest available priority dates for other than provisional patent applications or claims benefits under 35 USC § 119(e) for provisional patent applications, for any and all parent, grandparent, great-grandparent, etc. applications of the Related Application(s)).

TECHNICAL FIELD

The present invention relates to a photomultiplier tube (PMT), and more particularly, to a bias-variant PMT with extended lifetime through the application of a variant dynode bias.

BACKGROUND

As use of photomultiplier tubes (PMTs) continues, there is an increase in the demand for PMTs with extended lifetimes. PMTs amplify very small light signals. When light hits a cathode of a PMT, a photoelectron is created and accelerated towards a receiving dynode. The receiving dynode then amplifies the photoelectrons and directs them towards a second dynode. This process continues through a series of dynodes until the amplified photoelectron signal is collected at an anode. Typically, gain at each dynode scales with the energy of the incident electrons, which corresponds to the voltage difference between a given dynode and the previous dynode. It is generally observed that larger currents in latter dynodes cause degradation of the alkali coating(s), which enable the secondary emission necessary for signal amplification. The degradation in the coatings decreases the gain of a given stage even in cases where the energy of the incident electrons remains constant. As such, the total gain of the PMT is decreased. Consequently, even in the event an incident light signal stays constant, the signal measured at the anode of a given PMT will decrease as a function of time. Previous methods to mitigate this effect include adjusting the voltage values between the dynodes to restore the gain to its original value. At some point, however, the gain decreases to a level that the voltage cannot be increased sufficiently to counteract the gain loss. Therefore, it is desirable to provide a system and method which cures the deficiencies of the prior art described above.

SUMMARY

A bias-variant photomultiplier tube (PMT) is disclosed. In one illustrative embodiment, the bias-variant PMT may include, but is not limited to, a photocathode configured to absorb photons and emit photoelectrons responsive to the absorbed photons. In another illustrative embodiment, the bias-variant PMT may include, but is not limited to, a plurality of dynodes configured to receive the photoelectrons emanating from the photocathode. In another illustrative embodiment, the bias-variant PMT may include, but is not limited to, a first pair of dynodes having a first bias difference and at least a second pair of dynodes having a second bias difference different than the first bias difference. In another illustrative embodiment, the bias-variant PMT may include, but is not limited to, a bias-variant PMT wherein the second bias difference between the at least the second pair of dynodes being greater than the first bias difference between the first pair of dynodes. In another illustrative embodiment, the bias-variant PMT may include, but is not limited to, an anode configured to receive photoelectrons directed from the plurality of dynodes.

A method for biasing a photomultiplier tube (PMT) is disclosed. In one illustrative embodiment, the method for biasing a PMT may include, but is not limited to, generating an initial set of photoelectrons through secondary emission with absorption of photons with a photocathode. In another illustrative embodiment, the method for biasing a PMT may include, but is not limited to, directing the initial set of photoelectrons to a plurality of dynodes. In another illustrative embodiment, the method for biasing a PMT may include, but is not limited to, amplifying the initial set of photoelectrons to form a second set of photoelectrons with a first pair of dynodes having a first bias difference. In another illustrative embodiment, the method for biasing a PMT may include, but is not limited to, amplifying the second set of photoelectrons to form at least a third set of photoelectrons with at least a second pair of dynodes having at least a second bias difference greater than the first bias difference. In another illustrative embodiment, the method for biasing a PMT may include, but is not limited to, receiving the at least a third set of photoelectrons with an anode.

An inspection system with a bias-variant photomultiplier tube (PMT) sensor is disclosed. In one illustrative embodiment, the inspection system may include, but is not limited to, an illumination source configured to illuminate a portion of a sample surface. In another illustrative embodiment, the inspection system may include, but is not limited to, a bias-variant PMT sensor configured to detect at least a portion of light scattered from the surface of the sample. In another illustrative embodiment, the inspection system may include, but is not limited to, a set of collection optics configured to direct and focus at least a portion of light scattered from the surface of the sample through the bias-variant PMT sensor.

It is understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Referring generally to FIGS. 1A through 3, a bias-variant photomultiplier tube (PMT) 100 is described in accordance with the present disclosure. Embodiments of the present disclosure are directed to a bias-variant PMT 100 serving to provide resistance to gain degradation. A reduction in gain degradation results in an increase of the lifetime of the given PMT. Embodiments of the present disclosure are further directed to a bias-variant PMT 100 with multiple pairs of dynodes, with a first pair of dynodes having a first bias difference and a second pair of dynodes having a second bias difference. In one embodiment, the second bias difference is greater than the first bias difference (e.g., second bias difference is two times the first bias difference). It is noted herein that such a bias arrangement results in the reduction of gain degradation at the latter dynodes, thereby increasing the lifetime of the PMT 100.

Figure 1A:
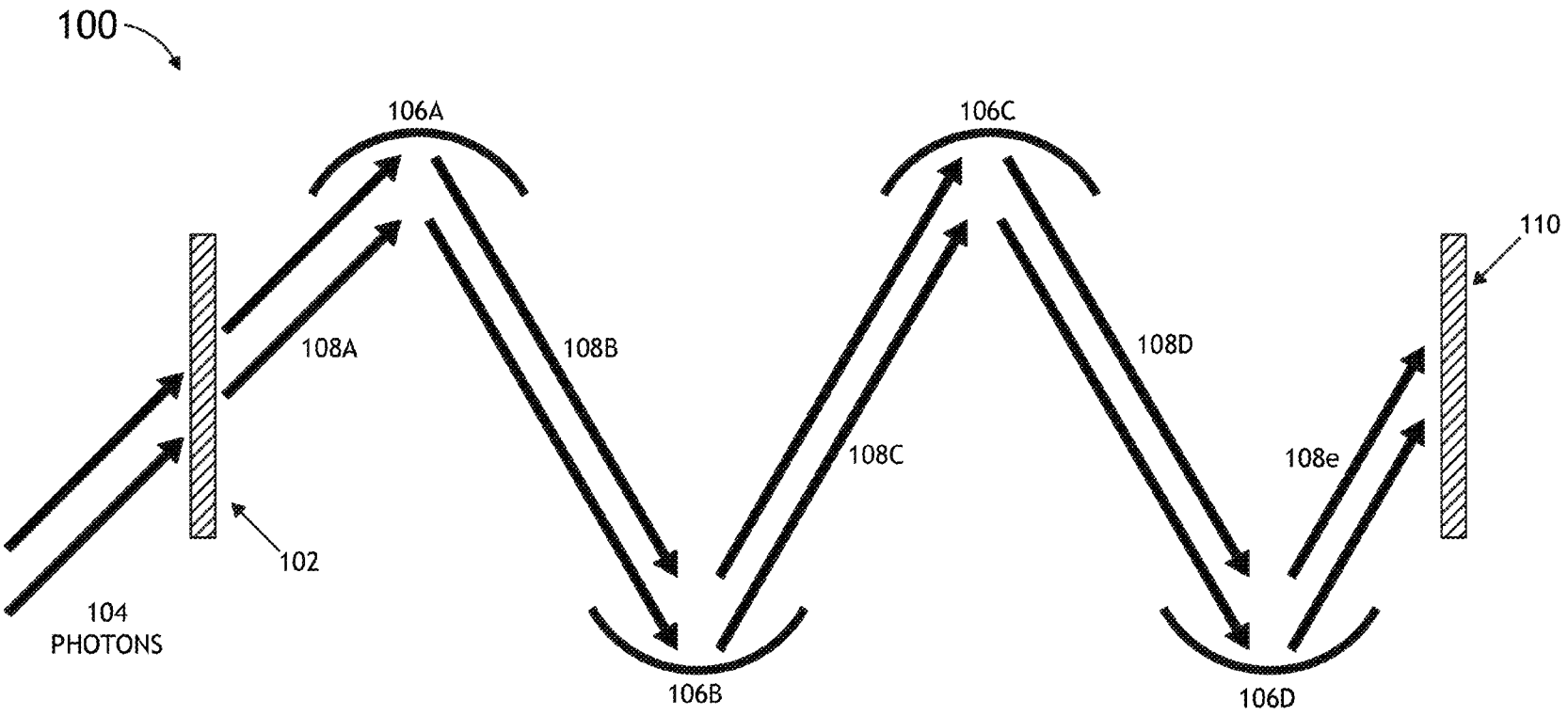
FIG. 1A illustrates a simplified schematic view of a bias-variant photomultiplier tube equipped with bias-variant dynodes, in accordance with an embodiment of the present invention.

FIG. 1A illustrates a bias-variant photomultiplier tube (PMT) 100, in accordance with an embodiment of the present invention. In one embodiment, the bias-variant PMT 100 includes a photocathode 102. In another embodiment, the photocathode 102 is configured to absorb photons 104. In another embodiment, the photocathode 102 emits photoelectrons 108*a-e* in response to the absorbed photons 104. In another embodiment, the photocathode 102 includes a transmission-type photocathode suitable for absorbing photons 104 at one surface of the photocathode 102 and emitting photoelectrons 108*a-e* from the opposite surface of the photocathode 102. In another embodiment, the photocathode 102 includes a reflective-type photocathode suitable for absorbing photons 104 at one surface and emitting photoelectrons 108*a-e* from the same surface of the photocathode 102. In another embodiment, the photocathode 102 is configured to absorb photons 104 from oblique incident angles and/or normal incident angles.

In one embodiment, the bias-variant PMT 100 includes a plurality of dynodes 106*a-d*. For example, the bias-variant PMT 100 may include a first dynode 106*a* configured to receive photoelectrons 108*a* emanating from the photocathode 102. In another embodiment, the bias-variant PMT 100 includes a first dynode 106*a* configured to amplify the photoelectron current 108*a* (e.g., via secondary emission) such that the photoelectron current 108*b* emanating from the first dynode 106*a* is larger than the current 108*a*. In another embodiment, the bias-variant PMT 100 includes a second dynode 106*b* that amplifies the photoelectron current 108*b* such that the current 108*c* is larger than the current 108*b*. In another embodiment, the bias-variant PMT 100 includes multiple dynodes 106*a-d* that amplify the photoelectron current to desired levels. In another embodiment, the last dynode (e.g., 106*d* in FIG. 1A) in the bias-variant PMT 100 is arranged to direct the amplified photoelectron current output so as to impinge on an anode 110.

In another embodiment, the bias-variant PMT 100 includes a first set of dynodes with multiple dynode pairs (e.g., 106*a* and 106*b* or 106*c* and 106*b*) that have different bias differences between them. For example, the bias-variant PMT 100 may include a first dynode 106*a* with a first bias and a second dynode 106*b* with a second bias, with the second bias being different than the first dynode 106*a* bias. In another embodiment, the bias-variant PMT 100 includes a first dynode 106*a* with a first set bias and second dynode 106*b* with a second set bias different than the first bias, whereby the difference between the first bias and the second bias creates a first bias difference. In another embodiment, the bias-variant PMT 100 includes a third dynode 106*c* with a third bias and a fourth dynode 106*d* with a fourth bias different than the third bias associated with the third dynode 106*c*. In another embodiment, the bias-variant PMT 100 includes a third dynode 106*c* with a third set bias and fourth dynode 106*d* with a fourth set bias different than the third bias, whereby the difference between the third bias and the fourth creates a second bias difference. In another embodiment, the second bias difference between the third dynode 106*c* and the fourth dynode 106*d* is greater than the first bias difference between the first dynode 106*a* and the second dynode 106*b*. In another embodiment, the bias-variant PMT 100 includes a second dynode pair which shares a dynode with a first dynode pair. For example, the bias-variant PMT 100 may include a first dynode 106*a* and a second dynode 106*b* that make up a first dynode pair with a first bias difference and the second dynode 106*b* and a third dynode 106*c* make up a second dynode pair with a second bias difference greater than the first bias difference.

In another embodiment, although not depicted, the bias-variant PMT 100 includes at least a second set of dynodes. In another embodiment, the bias-variant PMT 100 includes a first dynode of a second set of dynodes with a first bias configured to receive photoelectrons emanating from the photocathode. In another embodiment, the bias-variant PMT 100 includes a first pair of dynodes of a second set of dynodes having a first bias difference and at least a second pair of dynodes of a second set of dynodes having a second bias difference different than the first bias difference. In another embodiment, the bias-variant PMT 100 includes a second pair of dynodes of a second set of dynodes having a second bias difference greater than a first pair of dynodes of a second set of dynodes first bias difference.

In one embodiment, the bias-variant PMT 100 includes an anode 110. In another embodiment, the bias-variant PMT 100 includes an anode 110 configured to receive photoelectrons 100*a-e* directed from the plurality of dynodes 106*a-d*. In another embodiment, the bias-variant PMT 100 includes an anode 110 configured to convert the photoelectrons 108*a-e* from the plurality of dynodes 106*a-d* to light. In another embodiment, the bias-variant PMT 100 includes a detector (not shown) configured to detect illumination emanating from the anode 110. For example, the detector may include any detector known in the art, such as but not limited to, a CCD detector, or a TDI-CCD detector.

Figure 1B:
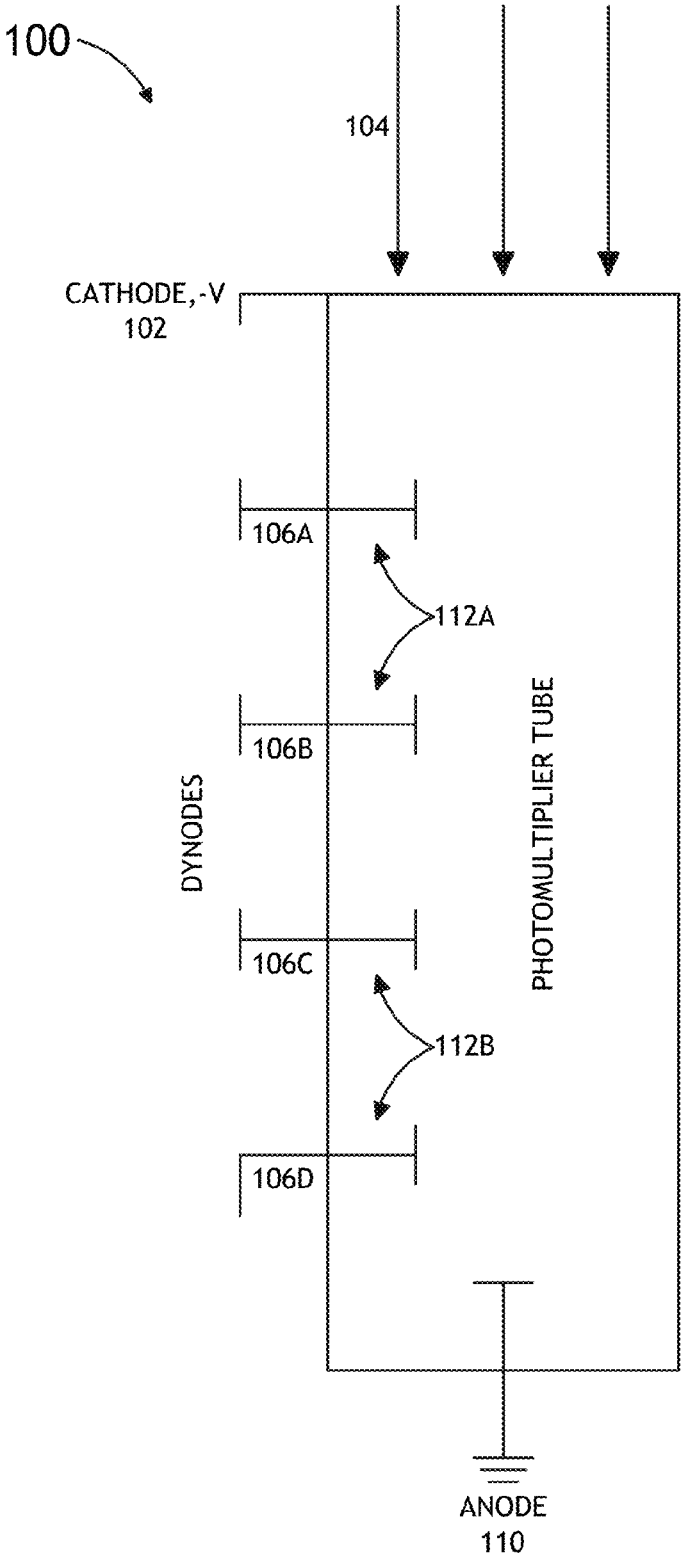
FIG. 1B illustrates a simplified schematic view of a bias-variant PMT with a resistive chain equipped differing resistivity, in accordance with an embodiment of the present invention.

FIG. 1B illustrates a bias-variant PMT 100 with a resistive chain with set resistivity 112*a* and 112*b*, in accordance with an embodiment of the present invention. In one embodiment, the bias-variant PMT 100 includes a resistive chain with a first pair of dynodes 106*a* and 106*b* and a second pair of dynodes 106*c* and 106*d*. In another embodiment, the resistivity 112*b* is at least greater than resistivity 112*a*. For example, the resistive chain may include having a resistivity 112*b* twice as large as resistivity 112*a*, which results in a greater voltage difference between the second pair of dynodes 106*c* and 106*d* than the first pair of dynodes 106*a* and 106*b*.

It is noted herein that the number of dynodes used in the bias-variant PMT 100 is not limited to the number of dynodes illustrated in FIG. 1A or 1B. The number of dynodes depicted in FIGS. 1A and 1B are provided merely for purposes of illustration and it is contemplated that any number of dynodes and dynode pairs may be utilized in the present invention. It is further noted that the choice of the number of dynodes and dynode pairs may ultimately depend on required amplification levels and cost, among other factors. It is further noted that the bias-variant PMT 100 is not limited to the resistive chain illustrated in FIG. 1B. The resistive chain depicted in FIG. 1B is provided merely for purposes of illustration and it is contemplated that any resistive chain configuration may be utilized in the present invention.

Figure 1C:
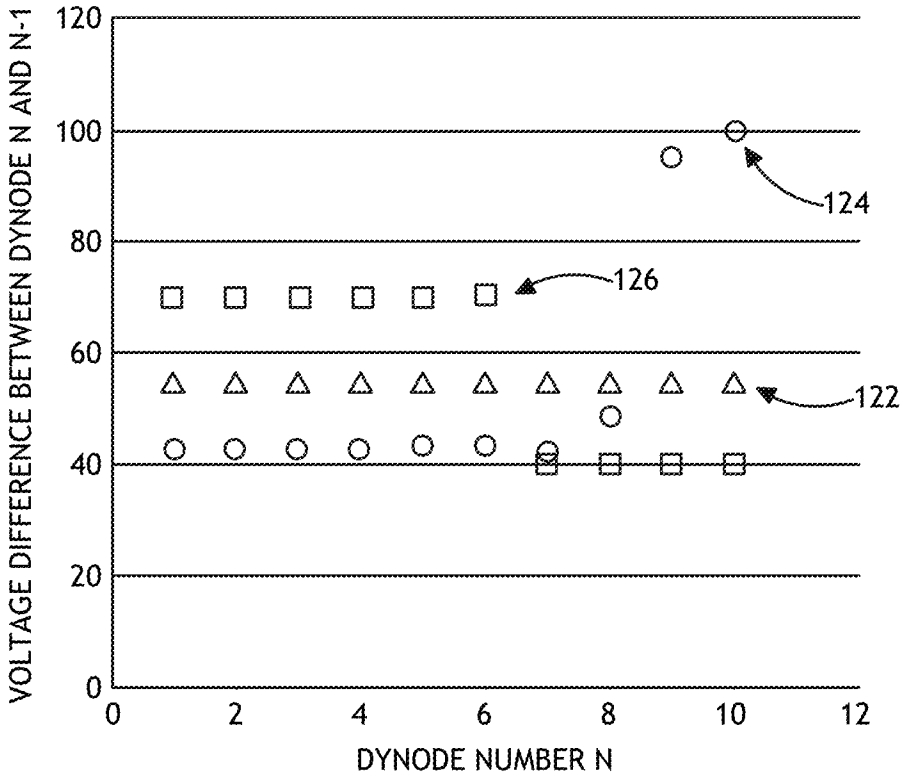
FIG. 1C illustrates the voltage differences in three different biasing schemes that result in the same overall gain, in accordance with an embodiment of the present invention.

FIG. 1C illustrates the voltage differences in three different biasing schemes that result in the same overall gain, in accordance with an embodiment of the present invention. The curve 122 illustrates the voltage difference between dynodes in a normally biased PMT (constant). The curve 124 illustrates the voltage differences consistent with the bias-variant PMT 100 as discussed throughout the present disclosure with the larger gain at the latter dynodes. The curve 126 illustrates the opposite of the bias-variant PMT 100 where the first dynodes are equipped with a larger bias difference than the latter dynodes used to determine if this shortens the life of a PMT. It is noted herein that all three biasing cases depicted in FIG. 1C were arranged to produce the same overall PMT gain.

Figure 1D:
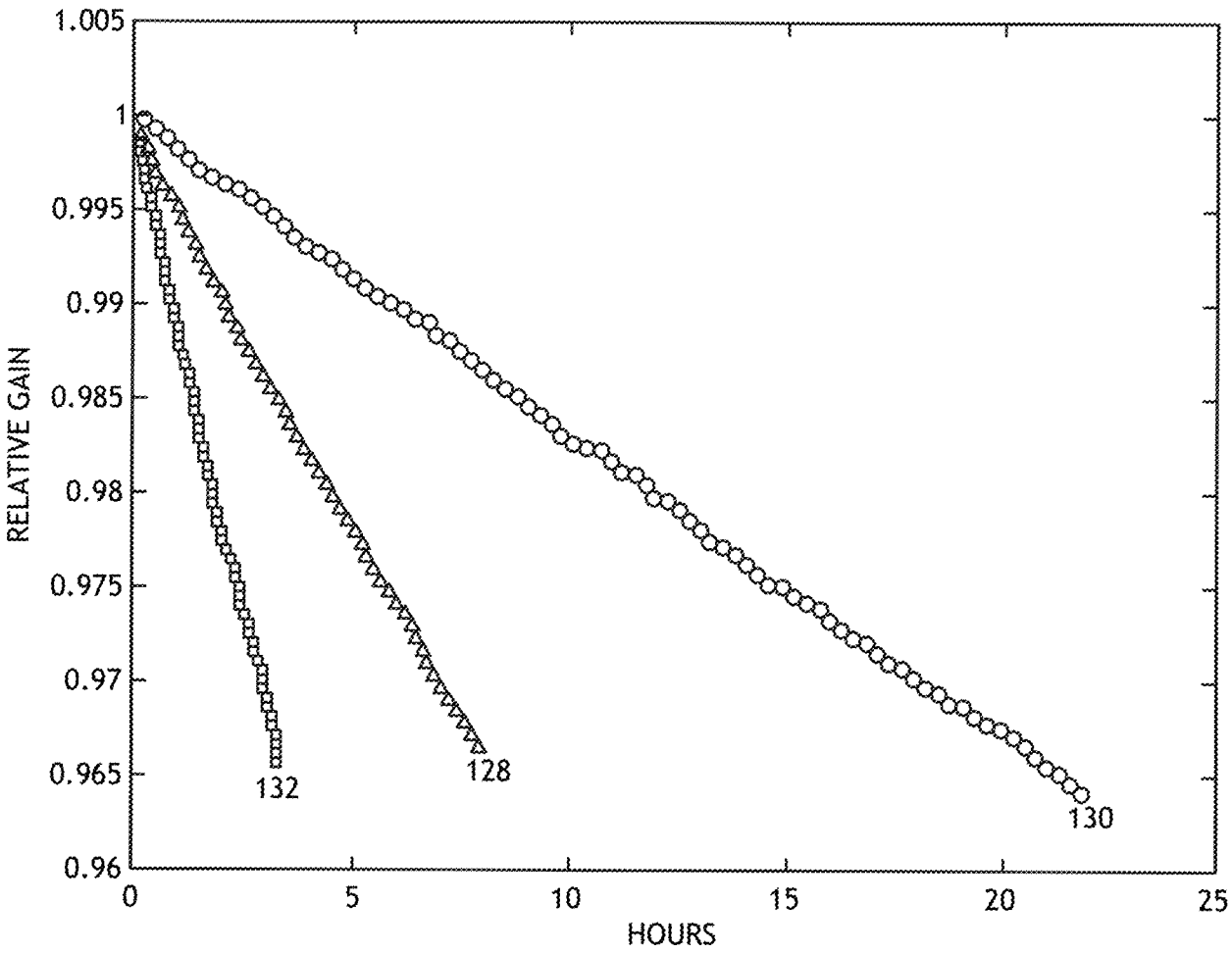
FIG. 1D illustrates the degradation curve of three different biasing schemes, in accordance with an embodiment of the present invention.

FIG. 1D illustrates the degradation curves associated with three different biasing schemes. The Line 128 illustrates the normally biased PMT 100, Line 130 illustrates the bias-variant PMT 100, and Line 132 illustrates the opposite of the bias-variant PMT 100. Each illustrated line uses the same light source and start with the same gain. All lines have the same anode current, but their degradation lines are vastly different as illustrated.

Figure 2:
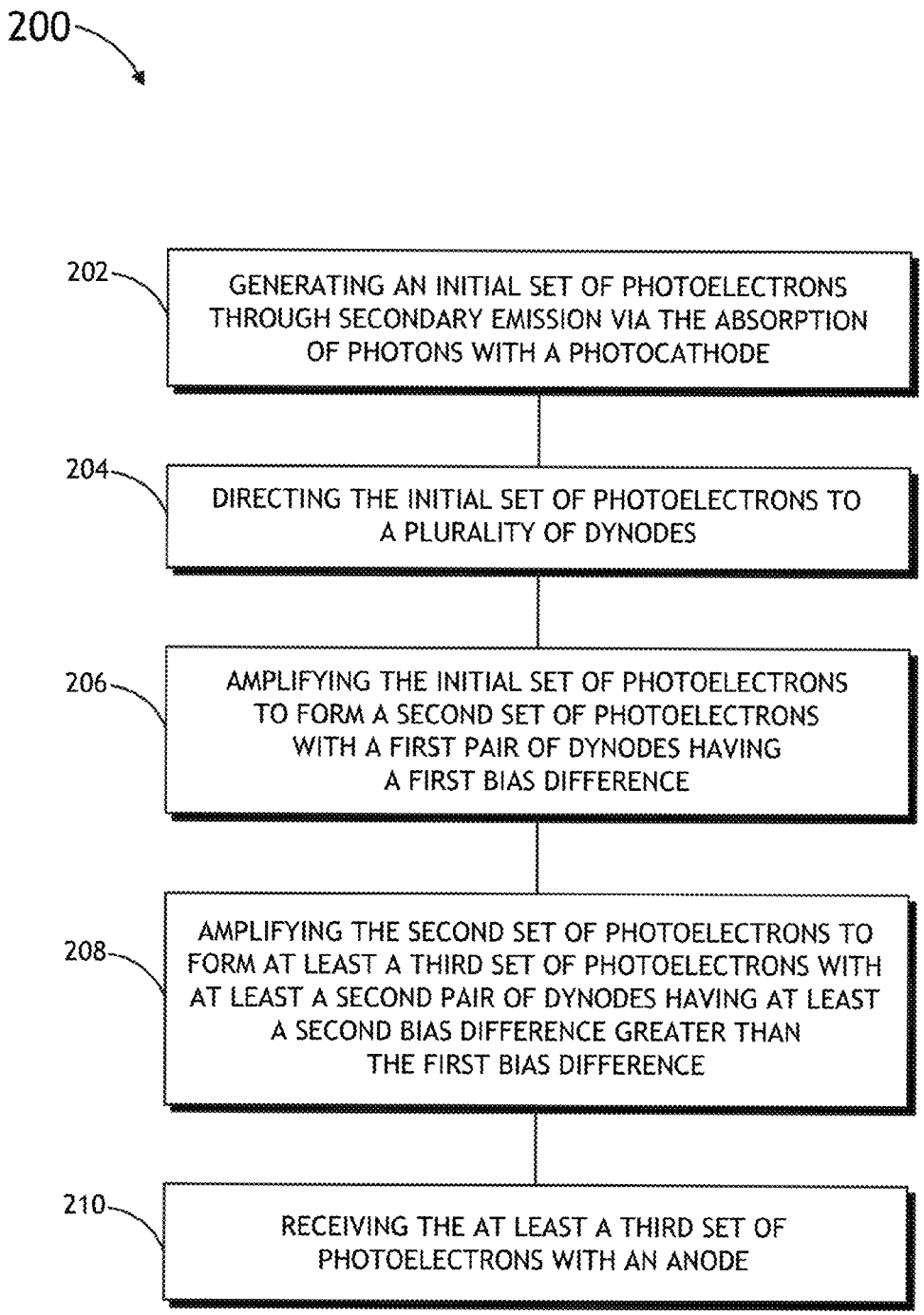
FIG. 2 illustrates a block diagram of a method for biasing a photomultiplier tube, in accordance with an embodiment of the present invention.

FIG. 2 illustrates a flow diagram 200 depicting a method 200 for amplifying a photoelectron signal in a PMT with non-uniform biasing, in accordance with one or more embodiments of the present disclosure. Step 202 generates an initial set of photoelectrons through absorption of photons with a photocathode. In another embodiment, the method for biasing 200 includes emitting (via secondary emission) photoelectrons via the absorption of photons from a photocathode. Step 204 directs the initial set of photoelectrons to a plurality of dynodes. Step 206 amplifies, with a first pair of dynodes having a first bias difference, an initial set of photoelectrons to form a second set of photoelectrons. Step 208 amplifies, with a second pair of dynodes having a second bias difference greater than the first bias difference, the second set of photoelectrons to form a third set of photoelectrons. Step 210, receives the photoelectrons with an anode.

Figure 3:
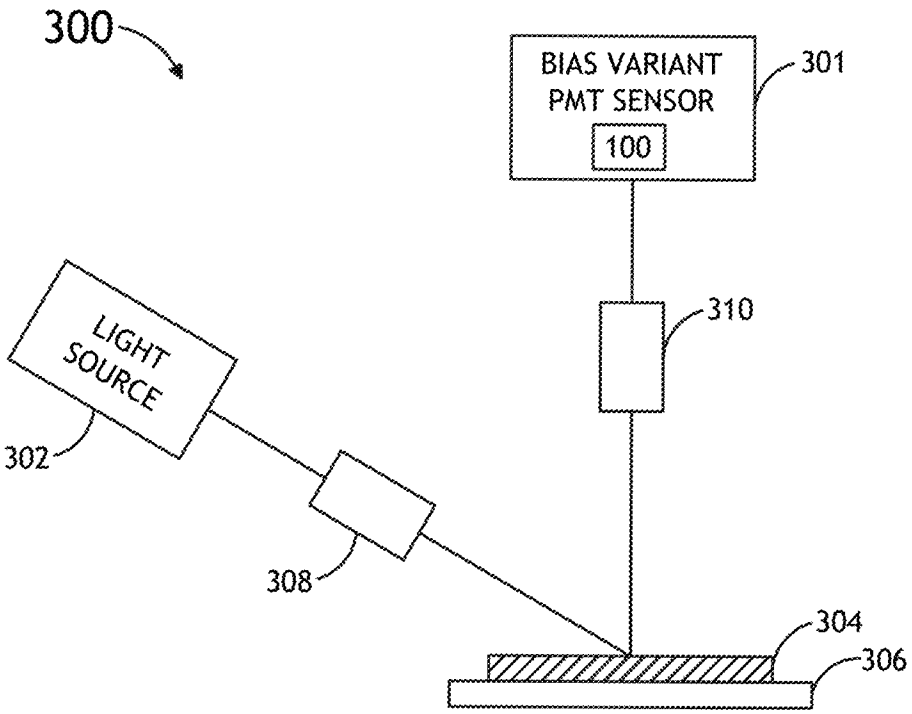
FIG. 3 illustrates a block diagram of an inspection system equipped with a bias-variant photomultiplier tube sensor, in accordance with an embodiment of the present invention.

FIG. 3 illustrates an optical system 300 equipped with a bias-variant PMT 100, in accordance with one or more embodiments of the present disclosure.

In one embodiment, the optical system 300 includes a bias-variant PMT sensor 301. In another embodiment, the bias-variant PMT sensor 301 of the optical system 300 includes one or more bias-variant PMTs, such as the bias-variant PMT 100 as described previously in the present disclosure. In another embodiment, the bias-variant PMT 100 in the bias-variant PMT sensor 301 includes a photocathode configured to absorb photons and emit photoelectrons responsive to the absorbed photons; a plurality of dynodes configured to receive the photoelectrons emitted from the photocathode, a first pair of dynodes having a first bias difference and at least a second pair of dynodes having a second bias difference greater than the first bias difference; and an anode configured to receive photoelectrons directed from the plurality of dynodes.

In one embodiment, the optical system 300 includes an illumination source 302 configured to generate illumination. In another embodiment, the illumination source 302 is configured to illuminate a portion of a surface of a sample 304 (e.g., semiconductor wafer) disposed on a sample stage 306. In another embodiment, the illumination source 302 includes one or more broadband light sources, such as a broad band lamp (e.g., xenon lamp). In another embodiment, the illumination source 302 includes one or more narrow-band light sources, such as one or more lasers emitting light at a selected wavelength.

In one embodiment, the optical system 300 includes a set of illumination optics 308 configured to direct and focus the illumination onto the sample surface 304. In another embodiment, the illumination optics 308 of the optical system 300 include any optical elements known in the art suitable for directing, processing, filtering, polarizing and/or focusing the light beam emanating from the illumination source 302 on to a portion of the surface of the sample 304. For example, the set of illumination optics may include, but are not limited to, one or more lenses, one or more mirrors, one or more beam splitters, one or more polarizer elements, one or more filters, and the like.

In another embodiment, the optical system 300 includes a set of collection optics 310 configured to direct and focus at least a portion of the light scattered from the surface of the sample 304 to an input of the bias-variant PMT sensor 301. In another embodiment, the collection optics 310 of optical system 300 include any optical elements known in the art suitable for collecting, directing, processing, filtering and/or focusing light scattered, reflected or diffracted from the surface of the sample 304 onto the bias-variant PMT sensor 301. For example, the set of collection optics 310 may include, but are not limited to, one or more lenses, one or more mirrors, one or more beam splitters, one or more filters, one or more polarizer elements, and the like.

In another embodiment, the optical system 300 is an inspection system, or inspection tool. In another embodiment, the optical system 300 is an optical metrology system, or inspection tool. In another embodiment, the illumination source 302, the illumination optics 308, the collection optics 310, and the bias-variant PMT sensor 301 may be arranged in a darkfield configuration such that the optical system 300 operates as a darkfield inspection system. In another embodiment, although not shown, the illumination source 302, the illumination optics 308, the collection optics 310, and the bias-variant PMT sensor 301 may be arranged in a brightfield configuration such that the optical system 300 operates as a brightfield inspection system.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It is believed that the present disclosure and many of its attendant advantages will be understood by the foregoing description, and it will be apparent that various changes may be made in the form, construction and arrangement of the components without departing from the disclosed subject matter or without sacrificing all of its material advantages. Furthermore, it is to be understood that the invention is defined by the appended claims.

What is claimed is:

1. A bias-variant photomultiplier tube (PMT) comprising:

a photocathode configured to absorb photons and emit photoelectrons responsive to the absorbed photons;

a plurality of dynodes including a first pair of successive dynodes having a first bias difference and a second pair of successive dynodes having a second bias difference greater than the first bias difference, wherein the first pair of successive dynodes is configured to receive the photoelectrons emitted from the photocathode; and an anode, wherein the anode is configured to receive photoelectrons from the second pair of successive dynodes.

2. The bias-variant PMT of claim 1, wherein a magnitude of the bias difference between the second pair of successive dynodes is between 1 and 2 times greater than the bias difference between the first pair of successive dynodes.

3. The bias-variant PMT of claim 1, wherein a magnitude of the bias difference between the second pair of successive dynodes is at least 2 times greater than the bias difference between the first pair of successive dynodes.

4. The bias-variant PMT of claim 1, wherein the second pair of successive dynodes has a dynode in common with the first pair of successive dynodes.

5. The bias-variant PMT of claim 1, wherein the anode converts the photoelectrons received from the plurality of dynodes to light.

6. The bias-variant PMT of claim 1, further comprising:

a detector configured to detect the light generated by the anode.

7. The bias-variant PMT of claim 1, wherein the photocathode is configured to absorb photons from at least one of oblique incident angles or normal incident angles.

8. A method for biasing a photomultiplier tube (PMT) comprising:

generating an initial set of photoelectrons through secondary emission via the absorption of photons with a photocathode;

directing the initial set of photoelectrons to a first pair of successive dynodes of a plurality of dynodes, wherein the first pair of successive dynodes has a first bias difference;

amplifying the initial set of photoelectrons to form a second set of photoelectrons with the first pair of successive dynodes;

amplifying the second set of photoelectrons to form a third set of photoelectrons with a second pair of successive dynodes of the plurality of dynodes, wherein the second pair of successive dynodes has a second bias difference greater than the first bias difference; and receiving the third set of photoelectrons with an anode.

9. An optical system comprising:

an illumination source configured to generate illumination;

a set of illumination optics configured to direct and focus the illumination onto the sample surface;

a bias-variant photomultiplier tube (PMT) sensor configured to detect at least a portion of light scattered, reflected, or defracted from the surface of the sample, wherein the bias-variant PMT sensor comprises:

a photocathode configured to absorb photons and emit photoelectrons responsive to the absorbed photons;

a plurality of dynodes including a first pair of successive dynodes having a first bias difference and a second pair of successive dynodes having a second bias difference greater than the first bias difference, wherein the first pair of successive dynodes is configured to receive the photoelectrons emitted from the photocathode; and an anode, wherein the anode is configured to receive photoelectrons from the second pair of successive dynodes; and a set of collection optics configured to direct and focus at least a portion of light scattered from the surface of the sample to an input of the bias-variant PMT sensor.

10. The bias-variant PMT sensor of claim 9, wherein a magnitude of the bias difference between the second pair of successive dynodes is between 1 and 2 times greater than the bias difference between the first pair of successive dynodes.

11. The bias-variant PMT sensor of claim 9, wherein a magnitude of the bias difference between the second pair of successive dynodes is at least 2 times greater than the bias difference between the first pair of successive dynodes.

12. The optical system of claim 9, wherein the second pair of successive dynodes has a dynode in common with the first pair of successive dynodes.

13. The optical system of claim 9, wherein the optical system includes an inspection system.

14. The optical system of claim 13, wherein the inspection system includes a dark field inspection system.

15. The optical system of claim 13, wherein the inspection system includes a bright field inspection system.

16. The optical system of claim 9, wherein the optical system includes an optical metrology system.

17. The optical system of claim 9, wherein the illumination source includes at least one of a narrowband source or a broadband source.

* * * * *